US005393085A

United States Patent [19]

Forneri

[11] Patent Number: 5,393,085

[45] Date of Patent: Feb. 28, 1995

[54] SHAPED SKI HAVING NON-RECTANGULAR CROSS SECTION

[75] Inventor: Jean-Marc Forneri, Saint Sauveur, France

[73] Assignee: Skis Rossignol S.A., Voiron, France

[21] Appl. No.: 979,916

[22] Filed: Nov. 23, 1992

[30] Foreign Application Priority Data

Nov. 22, 1991 [FR] France ..... 91 14694

[51] Int. Cl.[6] ..... A63C 5/07

[52] U.S. Cl. ..... 280/602; 280/610

[58] Field of Search ..... 280/602, 610, 601, 608, 280/609

[56] References Cited

U.S. PATENT DOCUMENTS

| | | | |
|---|---|---|---|
| 3,970,324 | 7/1976 | Howat | 280/610 |
| 4,300,786 | 11/1981 | Alley | 280/602 |
| 4,671,529 | 6/1987 | LeGrand et al. | 280/610 |
| 4,953,884 | 9/1990 | Diard et al. | 280/610 X |

*Primary Examiner*—Karin L. Tyson
*Assistant Examiner*—Michael Mar
*Attorney, Agent, or Firm*—Oliff & Berridge

[57] ABSTRACT

A ski having a shell forming its upper surface and its lateral sides, a core, and a lower surface comprising longitudinal bars located on either side of a sliding base further includes at least one stiffener, located in contact with one of the internal surfaces of the two lateral sides of shell, and located at least in the central part or runner zone of the ski.

31 Claims, 2 Drawing Sheets

SHAPED SKI HAVING NON-RECTANGULAR CROSS SECTION

BACKGROUND OF THE INVENTION

The present invention relates to shaped skis having non-rectangular cross sections.

Shaped skis, i.e., skis having a non-rectangular cross section including a shell forming the upper surface and lateral surfaces of the ski, with the side surfaces possibly being inclined over at least a portion of their height, are being manufactured increasingly frequently. In such skis, the slope at which the side surfaces are inclined can be constant or variable over the length of the ski and can be produced by plane or curved surfaces.

It is also known to make skis which have a foam-filled core composed of synthetic material, polyurethane for example, which possesses outstanding properties of stability over time, and is light in weight. It is possible to injection-mold the entire structure of the ski, or simply to make two side parts or side rails located on either side of a core, which are then located between the core and the shell.

In particular, it is known from FR 2 611 519 that a ski with a shell can be made having lateral surfaces formed by the shell which are sloped. Reinforcing elements composed of sheets of fabric impregnated with resin are provided in contact with the sloping walls of the shell.

However, the presence of these reinforcing elements is not sufficient to provide the ski with outstanding qualities. A ski of this type is especially lacking in rigidity with respect to twisting and lateral flexibility.

SUMMARY OF THE INVENTION

A goal of the present invention is to provide a shaped ski having a non-rectangular cross section and a shell forming the upper surface and lateral surfaces of the ski, which possesses esthetic and finish properties as a result of the presence of the shell, while offering valuable mechanical characteristics, i.e. high rigidity with respect to both twisting and lateral flexibility.

To this end, a ski according to the present invention comprises at least one stiffener, located in contact with the internal surface of one of the two parts of the shell forming the lateral surfaces of the shell, which extends over a portion of the height of this internal surface and is located at least in the middle part or runner zone of the ski.

These stiffeners ensure local reinforcement of the ski in the area where they are located and improve rigidity with respect to both twisting and lateral flexibility.

Each stiffener can be made independently of the shell and attached to the internal surface of the shell by known means, such as, for example, gluing, welding, clips, or the like. Each stiffener can be made of a material different from that of which the shell is made and in particular of a material that exhibits good mechanical reinforcement characteristics, such as, for example, glass, carbon, or aramid fiber.

Each stiffener can be made from a fabric impregnated with resin and forming at least one longitudinal layer of the stiffener. A plurality of stiffeners can be provided, staggered heightwise with respect to the ski and in contact with a given sloping surface of the shell.

According to another aspect of the present invention, each stiffener can be an integral part of the shell, and projects from the internal surface of the shell.

In the embodiment of a ski comprising lateral reinforcing elements, each stiffener is located between the shell and the lateral reinforcing elements.

As a result of the above arrangement, the lateral reinforcing elements, formed for example by resin-impregnated fabric, must follow the stiffeners, so that they no longer closely follow the sloping surfaces of the shell. The resultant curves in the lateral reinforcing elements ensure that these reinforcing elements are stiffened.

Each stiffener can be continuous and extend over the entire supporting part of the ski, i.e. between the front and rear areas of contact of the ski with the snow. Alternatively, each stiffener can be discontinuous and take the form of a plurality of sections staggered longitudinally relative to one another. These different sections can be made of different materials, with the section corresponding to the area of the runner being made for example of a far stronger material than the sections located closer to the ends, where it may be useful to attempt to damp vibration by using a viscoelastic material.

Similarly, each stiffener can have dimensions that are constant or variable over its length, and its positioning relative to the corresponding lateral surface of the shell can be constant or can vary over its length.

It is also possible to provide for a symmetry of two stiffeners located on both sides of a ski, or to give these profiles different dimensions and/or structural characteristics to lend the ski certain behavioral characteristics.

The invention will be clearly understood from the following description with reference to the attached figures illustrating nonlimiting examples of a plurality of embodiments of this ski.

DETAILED DESCRIPTION OF PREFERRED EMBODIMENTS

Figure 1:
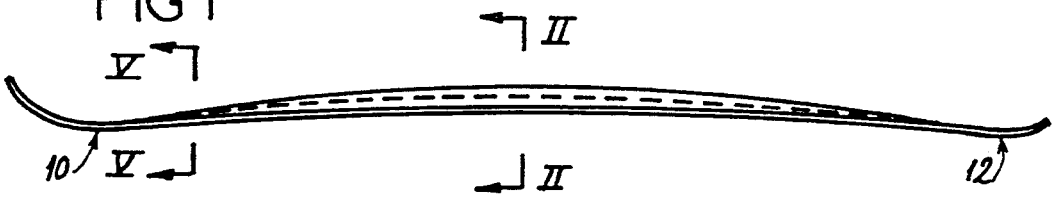
FIG. 1 is a side view of a ski.
Figure 2:
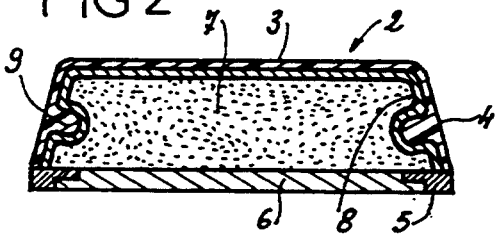
FIG. 2 is a section along line II—II in FIG. 1.

The ski shown in FIGS. 1 and 2 includes a shell 2 forming upper surface 3 and lateral sides 4 of the ski, a lower part defined by two longitudinal metal bars 5 and a sliding base 6, a filler core 7 made, for example, of polyurethane foam, and a lateral reinforcing element 8, formed, for example by a plurality of layers of resin-impregnated fabric, following the contours of the internal surfaces of the shell.

According to one aspect of the present invention, the inner surface of the shell is provided with two ribs 9 located essentially at mid-height. In one embodiment, the ribs are an integral part of the shell and are produced, for example, by extrusion therewith. As is clearly evident from FIG. 2, the presence of each rib 9 requires reinforcing element 8 to form a curve that essentially has the shape of a Greek letter omega. Under these conditions, ribs 9 forming the stiffeners improve the mechanical characteristics of the ski, while the movement afforded by each reinforcing element 8 at a rib 9 likewise improves the rigidity because of the shape the reinforcing element 8 is obliged to assume.

As FIG. 1 shows, the stiffeners defined by ribs 9 extend over the entire active length of the ski, i.e. between front and rear snow contact areas 10 and 12, respectively.

As shown in FIG. 2, stiffeners 9 extend over a portion of a height of the internal surface to which they are associated. That is, each stiffener extends over a portion of the total distance (height) between the lower and upper ends of each lateral side 4. Alternatively, it is possible for each stiffener to extend over the entire height of its associated lateral side 4 (i.e., from the lower end to the upper end of lateral side 4). Thus, in accordance with the present invention, each stiffener extends over at least a portion of the internal surface of its associated lateral side 4.

Figure 3:
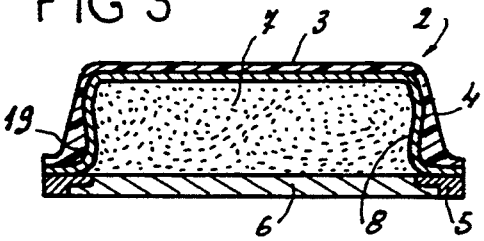
FIGS. 3 and 4 are two cross sections through two embodiments of this ski, again along line II—II in FIG. 1.

FIG. 3 shows a variation of the ski in which the same elements are designated by the same reference numerals as above. The main difference results from the location of stiffeners 19, no longer located at mid-height on the ski side surfaces, but instead in the bottom of the shell. This location is particularly useful in the runner area because it allows the contact surface of bars 5 to be made more rigid, since the assembly defined by each rib 19 and reinforcing element 8 covering the bar on the inside of the ski has a width essentially equal to the width of the bar. Thus, the forces exerted by the snow on each bar are transmitted directly to the upper surface of the ski on which the binding is mounted.

Figure 4:
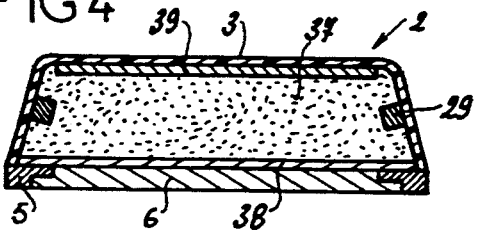

FIG. 4 shows a variation of the ski in which no lateral reinforcing elements are provided between stiffeners 29 and core 37, which can be made of polyurethane, for example. However, to obtain a ski with good characteristics, provision is made between the sole and the core for a steel sheet 38, and between the core and upper surface 3 of the shell for a reinforcing plate 39.

Figure 5:
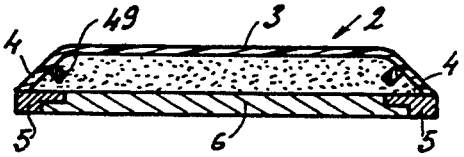
FIG. 5 is a cross section through another embodiment of this ski along line V—V in FIG. 1.

FIG. 5 shows a ski sectioned near one of its ends, without lateral reinforcing elements, without reinforcing elements (i.e., steel sheet 38) at the sole, and having stiffeners 49.

Figure 6:
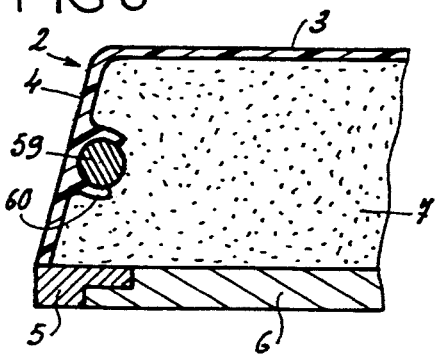
FIGS. 6–8 are three views corresponding to half cross sections of three skis, showing three types of stiffeners.

FIG. 6 shows an embodiment in which each stiffener is formed by a solid strip 59 attached to the interior of a lateral surface of the shell by projecting elements 60 forming clips.

Figure 7:
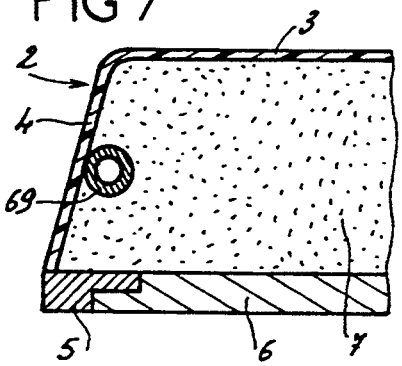
Figure 8:
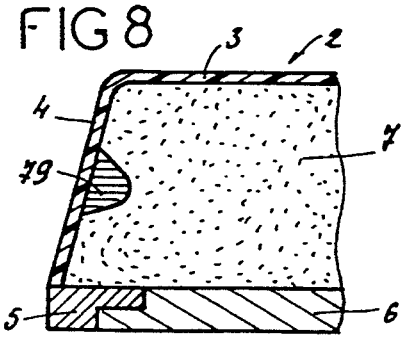

FIGS. 7 and 8 show two embodiments of stiffeners attached to the interior of a shell and held by known means, by gluing for example, with stiffener 69 shown in FIG. 7 being tubular, and stiffener 79 shown in FIG. 8 having a generally triangular shape.

Figure 9:
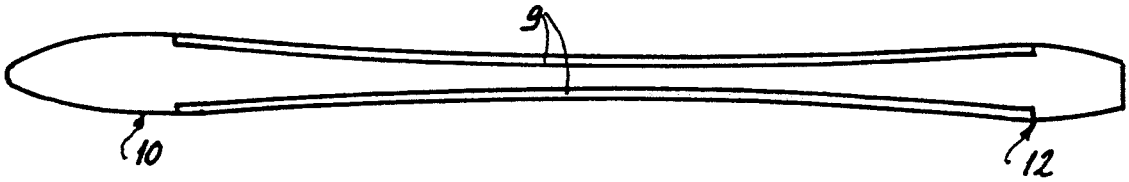
FIGS. 9 and 10 are two top views, with the shell removed, showing two forms of stiffeners.
Figure 10:
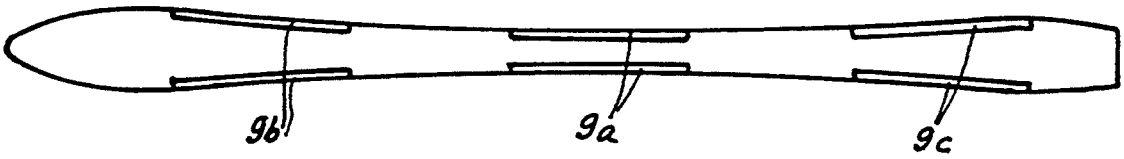

FIGS. 9 and 10 show two ways of installing stiffeners.

In the embodiment shown in FIG. 9 the ski includes two stiffeners 9 that are continuous and extend from front snow contact zone 10 to rear snow contact zone 12.

The ski shown in FIG. 10 is equipped with two discontinuous stiffeners, each having a central part 9*a* located in the runner area, and two end parts 9*b* and 9*c* located at the tip and tail, respectively. The three sections 9*a*, 9*b* and 9*c* can be made of the same material, or of different materials, and can possess, or not possess, the same dimensions and the same locations relative to the lateral surface of the shell with which they are associated.

It is likewise possible to provide a change in the dimensions, location, and/or nature of the materials of which the stiffeners associated with the two lateral surfaces of the ski are made.

As indicated above, the present invention represents a considerable improvement in existing technology by providing a ski with improved qualities, especially rigidity with respect to both twisting and lateral flexibility, and in which the side walls are reinforced when associated with a reinforcing element that follows the profile of the stiffener or stiffeners.

Of course, the invention is not limited to the embodiments described above, but includes all variations thereon.

Thus, in particular, it is possible to provide a ski with only one stiffener associated with one lateral surface of the shell, for example, to increase the rigidity of the contact with the internal bar. For example, it is possible to associate a plurality of stiffeners staggered heightwise on each lateral surface of the ski, or for the specific characteristics described with reference to one embodiment to be combined with other characteristics presented with reference to other embodiments without departing from the scope of the invention defined in the following claims.

What is claimed is:

1. A shaped ski having front, central and rear zones and having a non-rectangular cross section defined by an exterior shell forming an upper surface and lateral sides of the ski, a core inside said shell, said core including at least lateral portions made from a synthetic foam, and a lower surface attached to the shell and defined by longitudinal bars located on either side of a sliding base, said ski further comprising at least one longitudinally extending stiffener in contact with an internal surface of at least one of the lateral sides of the shell and located at least in a central zone of the ski, said stiffener extending over only a middle portion of a height of said internal surface of said lateral side.

2. The ski according to claim 1, wherein said at least one stiffener is a separate piece from said shell and is mounted on the internal surface by glue.

3. The ski according to claim 2, wherein said at least one stiffener is made of a material different from a material of which the shell is made, said stiffener material having mechanical reinforcing characteristics better than said shell material.

4. The ski according to claim 2, wherein said at least one stiffener is a resin-impregnated fabric forming at least one longitudinal layer.

5. The ski according to claim 1, wherein said at least one stiffener extends continuously over an entire supporting surface of the ski, between a front snow contact area and a rear snow contact area.

6. The ski according to claim 1, wherein said at least one stiffener is discontinuous and includes a plurality of sections spaced longitudinally relative to one another.

7. The ski according to claim 6, wherein said plurality of sections are made of materials which differ from one another.

8. The ski according to claim 1, wherein said at least one stiffener has dimensions that are constant over an entire longitudinal length of said at least one stiffener.

9. The ski according to claim 1, wherein said at least one stiffener has dimensions that vary over a longitudinal length of said at least one stiffener.

10. The ski according to claim 1, wherein a height position of said at least one stiffener on the internal surface of the shell is constant over an entire longitudinal length of the at least one stiffener.

11. The ski according to claim 1, wherein a height position of said at least one stiffener on the internal surface of the shell varies as a function of a respective position of said at least one stiffener along the ski.

12. The ski according to claim 1, wherein two stiffeners are provided, each of said two stiffeners being mounted on a respective one of the internal surfaces of said lateral sides of the shell and having the same dimensions and corresponding height positions.

13. The ski according to claim 1, wherein two stiffeners are provided, each of said two stiffeners being mounted on a respective one of the internal surfaces of said lateral sides of the shell and having different dimensions from one another.

14. The ski according to claim 13, wherein said two stiffeners are attached at different height positions on their respective lateral sides of the shell.

15. The ski according to claim 14, wherein said two stiffeners are made from different materials.

16. The ski according to claim 1, wherein two stiffeners are provided, each of said two stiffeners being mounted on a respective one of the internal surfaces of said lateral sides of the shell, and attached at different height positions on their respective lateral sides of the shell.

17. The ski according to claim 1, wherein two stiffeners are provided, each of said two stiffeners being mounted on a respective one of the internal surfaces of said lateral sides of the shell, said two stiffeners being made from different materials.

18. The ski according to claim 1, wherein said synthetic foam is polyurethane.

19. The ski according to claim 1, wherein said at least one stiffener is located on the internal surface spaced from said upper surface of the shell.

20. The ski according to claim 19, wherein said at least one stiffener is located on the internal surface at a position adjacent to at least one of the longitudinal bars of said lower surface.

21. The ski according to claim 1, wherein said at least one stiffener is a separate piece from said shell and is welded to said internal surface.

22. The ski according to claim 1, wherein said at least one stiffener is a separate piece from said shell, and further comprising clips attaching said at least one stiffener to said internal surface.

23. The ski according to claim 22, wherein said clips are unitary with said internal surface.

24. The ski according to claim 3, wherein said at least one stiffener is made from a material selected from the group consisting of glass, carbon and aramid fibers.

25. The ski according to claim 1, wherein said at least one stiffener is a solid strip.

26. The ski according to claim 1, wherein said at least one stiffener is a hollow tube.

27. The ski according to claim 1, wherein said at least one stiffener is triangular in cross-section.

28. The ski according to claim 1, wherein each internal surface includes a stiffener that extends over only a middle portion of the height of each internal surface of the shell.

29. The ski according to claim 1, wherein each of said lateral sides has substantially planar internal surfaces.

30. A shaped ski having front, central and rear zones and having a non-rectangular cross section defined by an exterior shell forming an upper surface and lateral sides of the ski, a core inside said shell, said core including at least lateral portions made from a synthetic foam, and a lower surface attached to the shell and defined by longitudinal bars located on either side of a sliding base, said ski further comprising at least one longitudinally extending stiffener in contact with an internal surface of at least one of the lateral sides of the shell and located at least in a central zone of the ski, said stiffener extending over only a portion of a height of said internal surface of said lateral side, wherein said at least one stiffener is one-piece with said shell and projects inwardly from the internal surface of said shell.

31. A shaped ski having front, central and rear zones and having a non-rectangular cross section defined by an exterior shell forming an upper surface and lateral sides of the ski, a core inside said shell, said core including at least lateral portions made from a synthetic foam, and a lower surface attached to the shell and defined by longitudinal bars located on either side of a sliding base, said ski further comprising at least one longitudinally extending stiffener in contact with an internal surface of at least one of the lateral sides of the shell and located at least in a central zone of the ski, said stiffener extending over only a middle portion of a height of said internal surface of said lateral side, wherein said ski includes lateral reinforcing elements located against the shell internal surface, and said at least one stiffener is located between the shell and the reinforcing elements.

* * * * *